United States Patent [19]

Hamner

[11] Patent Number: 4,832,819

[45] Date of Patent: May 23, 1989

[54] PROCESS FOR THE HYDROISOMERIZATION AND HYDROCRACKING OF FISHER-TROPSCH WAXES TO PRODUCE A SYNCRUDE AND UPGRADED HYDROCARBON PRODUCTS

[75] Inventor: Glen P. Hamner, Baton Rouge, La.

[73] Assignee: Exxon Research and Engineering Company, Florham Park, N.J.

[21] Appl. No.: 135,011

[22] Filed: Dec. 18, 1987

[51] Int. Cl.[4] ..... C10G 73/38; C10G 73/42

[52] U.S. Cl. ..... 208/27; 585/736; 585/737; 585/738; 585/748; 585/253; 208/24; 208/58; 208/59; 208/61; 208/85; 208/88; 208/93; 208/95; 208/112

[58] Field of Search ..... 208/24, 27, 59, 85, 208/92, 93, 94, 100, 112, 58, 61, 88, 95; 585/736, 737, 738, 748, 253, 9

[56] References Cited

U.S. PATENT DOCUMENTS

| | | | |
|---|---|---|---|
| 2,668,790 | 2/1954 | Good et al. | 208/20 |
| 2,817,693 | 12/1957 | Koome et al. | 208/112 |
| 3,052,622 | 9/1962 | Johnson et al. | 208/27 |
| 3,268,436 | 8/1966 | Arey, Jr. et al. | 208/59 |
| 3,268,439 | 8/1966 | Tupman et al. | 208/112 |
| 3,308,052 | 3/1967 | Ireland et al. | 208/27 |
| 3,365,390 | 1/1968 | Egan et al. | 208/18 |
| 3,619,408 | 11/1969 | Larson | 208/57 |
| 3,620,960 | 11/1971 | Kozlowski et al. | 208/59 |
| 3,630,885 | 12/1971 | Egan | 208/59 |
| 3,674,681 | 7/1972 | Lyon | 208/18 |
| 3,681,232 | 8/1972 | Egan | 208/58 |
| 3,692,695 | 9/1972 | Suggitt et al. | 208/112 |
| 3,840,614 | 10/1974 | Kravitz et al. | 208/112 |
| 3,870,622 | 3/1975 | Ashton et al. | 208/93 |
| 4,067,797 | 1/1978 | Chen et al. | 208/93 |
| 4,186,078 | 1/1980 | Itoh et al. | 208/27 |
| 4,684,756 | 8/1987 | Derr, Jr. et al. | 585/330 |

*Primary Examiner*—Anthony McFarlane
*Attorney, Agent, or Firm*—Roy J. Ott

[57] ABSTRACT

A process for producing a pumpable syncrude from a Fischer-Tropsch wax by fractionating the wax into relatively low boiling fraction containing oxygenate compounds and a relatively high boiling fraction which is substantially free of oxygenate compounds and thereafter isomerizing/hydrocracking the low boiling fraction in the presence of hydrogen and a fluorided Group VIII metal-on-alumina catalyst. The preferred Group VIII metal is platinum.

The pumpable syncrude is thereafter fractionated to produce a low boiling fraction which is thereafter isomerized/hydrocracked in the presence of hydrogen and a fluorided Group VIII metal-on-alumina catalyst to produce upgraded middle distillate fuel products. The preferred catalyst for middle distillate production is a fluorided platinum-on-alumina catalyst where a major portion of the fluoride within the catalyst is present as aluminum fluoride hydroxide hydrate.

10 Claims, 2 Drawing Sheets

PROCESS FOR THE HYDROISOMERIZATION AND HYDROCRACKING OF FISHER-TROPSCH WAXES TO PRODUCE A SYNCRUDE AND UPGRADED HYDROCARBON PRODUCTS

BACKGROUND OF THE INVENTION

I. Field of the Invention

This invention relates to a process for producing a pumpable syncrude from a synthetic paraffin wax. More particularly, it relates to a process for hydroisomerizing and cracking a Fischer-Tropsch wax to produce a pumpable syncrude which can be further processed to make more valuable normally liquid hydrocarbons.

II. Description of the Prior Art

In the Fischer-Tropsch process a synthesis gas ($CO+H_2$) made, e.g., from natural gas, is converted over a catalyst, e.g., a ruthenium, iron or cobalt catalyst, to form a wide range of products inclusive of gaseous and liquid hydrocarbons, and oxygenates, and a normally solid paraffin wax which does not contain the sulfur, nitrogen or metals impurities normally found in crude oil. It is generally known to selectively catalytically convert the paraffin wax, or syncrude obtained from such process to lower boiling paraffinic hydrocarbons falling within the gasoline and middle distillate boiling ranges.

Paraffin waxes have been isomerized over various catalysts, e.g., Group VIB and VIII catalysts of the Periodic Table of the Elements (E. H. Sargent & Co., Copyright 1964 Dyna-Slide Co.) Certain of such catalysts can be characterized as halogenated supported metal catalysts, e.g., a hydrogen chloride or hydrogen fluoride treated platinum-on-alumina catalyst as disclosed, e.g., in U.S. Pat. No. 2,668,866 to G. M. Good et al. In the Good et al process a partially vaporized wax, such as one from a Fischer-Tropsch synthesis process, is mixed with hydrogen and contacted at 300° C. to 500° C. over a bed of supported platinum catalyst. Palladium or nickel may be substituted for platinum. The support may be a number of conventional carrier materials, such as alumina or bauxite. The carrier material may be treated with acid, such as HCl or HF, prior to incorporating the platinum. In preparing the catalyst, pellets of activated alumina may be soaked in a solution of chloroplatinic acid, dried and reduced in hydrogen at 475° C.

U.S. Pat. No. 2,817,693 discloses the catalyst and process of U.S. Pat. No. 2,668,866 with the recommendation that the catalyst be pretreated with hydrogen at a pressure substantially above that to be used in the process.

U.S. Pat. No. 3,268,439 relates to the conversion of waxy hydrocarbons to give products which are characterized by a higher isoparaffin content than the feedstock. Waxy hydrocarbons are converted at elevated temperature and in the presence of hydrogen by contacting the hydrocarbons with a catalyst comprising a platinum group metal, a halogenatable inorganic oxide support and at least one weight percent of fluorine, the catalyst having been prepared by contacting the support with a fluorine compound of the general formula:

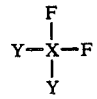

where X is carbon or sulphur and Y is fluorine or hydrogen.

U.S. Pat. No. 3,308,052 describes a hydroisomerization process for producing lube oil and jet fuel from waxy petroleum fractions. According to this patent, product quality is dependent upon the type of charge stock, the amount of liquid hydrocarbon in the waxy charge stock and the degree of conversion to products boiling below 650° F. The greater the amount of charge stock converted to material boiling below 650° F. per pass the higher the quality of jet fuel. The catalyst employed in the hydroisomerization zone is a platinum group metal catalyst comprising one or more platinum, palladium and nickel on a support, such as alumina, bentonite, barite, faujasite, etc., containing chlorine and/or fluorine.

In U.S. Pat. No. 3,365,390 a heavy oil feed boiling at least partly above 900° F. is hydrocracked and the oil effluent thereof is separated into fractions, including a distillate fuel and a higher boiling hydrocracked lube oil boiling range fraction. The hydrocracked lubricating oil boiling range fraction is dewaxed to obtain a hydrocracked wax fraction which is hydroisomerized in the presence of a reforming catalyst and the oil effluent thereof is separated into fractions, including a distillate fuel and an isomerized lube oil boiling range fraction.

In U.S. Pat. No. 3,486,993 the pour point of a heavy oil is lowered by first substantially eliminating organic nitrogen compounds present in the oil and then contacting the nitrogen-free oil with a reforming catalyst in a hydrocracking-hydroisomerization zone. Hydroisomerization is conducted at a temperature of 750° F.–900° F. over a naphtha reforming catalyst containing no more than two weight percent halide.

U.S. Pat. No. 3,487,005 discloses a process for the production of low pour point lubricating oils by hydrocracking a high pour point waxy oil feed boiling at least partly above 700° F. in at least two stages. The first stage comprises a hydrocracking-denitrofication stage, followed by a hydrocracking-isomerization stage employing a naphtha reforming catalyst containing a Group VI metal oxide or Group VIII metal on a porous refractory oxide, such as alumina. The hydrocracking isomerization catalyst may be promoted with as much as two weight percent fluorine.

U.S. Pat. No. 3,709,817 describes a process which comprises contacting a paraffin hydrocarbon containing at least six carbon atoms with hydrogen, a fluorided Group VIIB or VIII metal alumina catalyst and water. These catalysts are classified by the patentee as a well-known class of hydrocracking catalysts.

SUMMARY OF THE INVENTION

A process for producing a pumpable syncrude from a Fischer-Tropsch wax containing oxygenate compounds, which process comprises:

(1) separating the Fischer-Tropsch wax into (a) a low-boiling fraction which contains most of the oxygenate compounds and (b) a high-boiling fraction which is substantially free of water and oxygenate compounds, (2) reacting the high-boiling fraction from step (1) with hydrogen at hydroisomerization and mild hydrocracking conditions in the presence of a fluorided Group VIII metal-on-alumina catalyst to produce a $C_5+$ hydrocarbon product, and (3) combining the $C_5+$ hydrocarbon product from step (2) with the low-boiling fraction from step (1) to produce a pumpable, refinery processable syncrude that can be transported at atmospheric conditions.

In a further embodiment of the invention, the pumpable syncrude is processed to produce upgraded hydrocarbon products such as gasoline, middle distillates and lubricating oils. The pumpable syncrude is fractionated to produce at least a middle distillate fraction and a residual fraction which generally has an initial boiling point ranging between about 650° F. and about 750° F., preferably between about 625° F. and about 725° F., for example a 700° F.+ fraction. The residual fraction is reacted at isomerization/hydrocracking conditions with hydrogen in the presence of a Group VIII metal-on-alumina catalyst to produce a middle distillate fuel, lighter products, and a residual product which is recycled to extinction, further processed to make lubricating oils or further processed in another isomerization/hydrocracking zone to produce middle distillate, and lighter products.

DESCRIPTION OF THE PREFERRED EMBODIMENTS

In accordance with the invention, a Fischer-Tropsch wax is upgraded to a pumpable syncrude which can be shipped to distant refineries in various parts of the world via conventional tankers, or tankers which do not require special facilities to maintain the syncrude in a liquefied state. Thus, natural gas at or near the well site may be converted under known conditions to a synthesis gas ($CO+H_2$) which may then be converted by the Fischer-Tropsch process to form gaseous and liquid hydrocarbons and a normally solid paraffin wax known as Fischer-Tropsch wax. Olefinic hydrocarbons are concentrated in the lighter wax fractions. This wax does not contain the sulfur, nitrogen or metal impurities normally found in crude oil, but it is known to contain water and a number of oxygenate compounds such as alcohols, ketones, aldehydes and acids. These oxygenate compounds have been found to have an adverse effect on the performance of the hydroisomerization/-hydrocracking catalyst of the invention and it is, therefore, advantageous to produce a pumpable syncrude by the process scheme outlined in FIG. 1.

Figure 1:
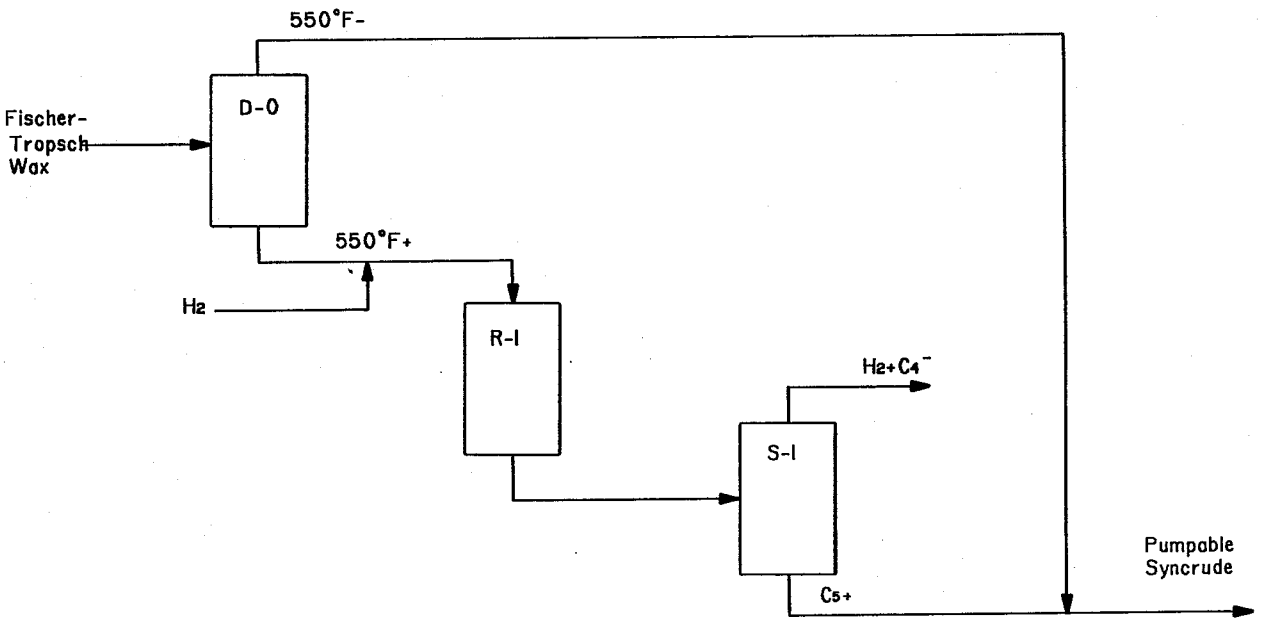
FIG. 1 schematically depicts a process of the invention for the production of a pumpable refinery processable syncrude from a Fischer-Tropsch wax by reaction with hydrogen over a fixed bed of the catalyst of this invention in a hydroisomerization and hydrocracking reactor.

Referring to FIG. 1, a virgin Fischer-Tropsch wax is first separated by distillation in distillation column D-0 into two fractions, a low boiling fraction containing water and olefinic-oxygenate-components, and a high-boiling fraction which is substantially devoid of water and olefinic-oxygenate components. Preferably, the high-boiling fraction will contain less than 0.5 wt. % oxygen, more preferably less than 0.3 wt. % oxygen. This can be accomplished generally by establishing a cut point between about 450° F. and about 650° F., preferably between about 500° F. and about 600° F., suitably, e.g., at about 550° F. Thus, a 550° F.− fraction, or hydrocarbon fraction having a high end boiling temperature of 550° F. (i.e., 550° F.−) contains most of the oxygenates, and a higher boiling fraction, suitably a 550° F.+ fraction, is substantially devoid of oxygenates. The pour point of the low-boiling, or 550° F.−fraction is relatively low, while the melt point of the high-boiling, or 550° F.+fraction, is quite high, i.e., >200° F.

A fluorided, Group VIII metal, alumina catalyst of this invention is charged into a reactor R-1 and provided therein as a fixed bed, or beds. The hot liquid high-boiling, or 550° F.+ Fischer-Tropsch wax from which the 550° F.− fraction is first separated via distillation in D-0 is charged as a feed, with hydrogen, into reactor R-1 and reacted at hydroisomerizing and mild hydrocracking conditions over said bed of catalyst. Hydrogen consumption and water formation are low because most of the olefins and oxygenates were removed from the original Fischer-Tropsch wax on separation of the low-boiling, or 550° F.− fraction therefrom. Suitably, such reaction is carried out at temperatures ranging between about 500° F. and about 750° F., preferably from about 625° F. to about 700° F., at a feed space velocity of from about 0.2 to about 2 V/V/Hr. (volume of feed per volume of reactor per hour), preferably from about 0.5 to about 1 V/V/Hr. Pressure is maintained at from about 250 pounds per square inch gauge (psig) to about 1500 psig, preferably from about 500 psig to about 1000 psig, and hydrogen is fed into the reactor at a rate of about 500 SCF/B (standard cubic feet of hydrogen per barrel of feed) to about 15,000 SCF/B, preferably from about 4000 SCF/B to about 7000 SCF/B. The total effluent from the reactor R-1 is introduced into a stabilizer vessel S-1 from the top of which is removed a small quantity of $C_4$- gaseous hydrocarbons, and hydrogen which is separated from the gaseous hydrocarbons via means not shown and recycled to reactor R-1. A $C_5+$ liquid product is removed from S-1 and blended with the 550° F.− fraction from D-0 to form a pumpable syncrude, typically one having an initial boiling point ranging between about 100° F. and a high end point of about 1600° F., typically about 100° F., and a high end boiling point ranging between about 1200° F. and about 1600° F., containing about 30 percent to about 50 percent 1050° F.+ fraction, based on the total weight of the syncrude. The syncrude is readily pumpable, and can be handled by conventional tankers without special heating equipment. The syncrude is typically one having a pour point ranging from about 40° F. to about 70° F. (ASTM-D-97), and a viscosity ranging from about 5 to about 50 C.S. at 100° F., preferably from about 6 to about 20 C.S. at 100° F. (min. 300 CS @100° F., ASTM-D-2270).

In a further embodiment of the invention, the pumpable syncrude is processed to produce upgraded hydrocarbon products such as gasoline, middle distillates and lubricating oils. The pumpable syncrude contains essentially no sulfur or nitrogen, and is very low in aromatics. The syncrude is predominantly n-paraffins, especially those of relatively high boiling points. Nonetheless, middle distillate fuels, notably jet and diesel fuels, can be made from the syncrude. To maximize middle distillate fuels, the syncrude is first distilled to produce middle distillate fractions, and lighter, suitably by separating out these components and further treating the residual fraction, which generally has an initial boiling point ranging between about 650° F. and about 750° F., preferably between about 625° F. and about 725° F., suitably, e.g., a 700° F.+ fraction which can be reacted, with hydrogen, at hydrocracking-hydroisomerization conditions over a bed of fluorided Group VIII metal-on-alumina catalyst of this invention in a second reactor as described by reference to FIG. 2.

Figure 2:
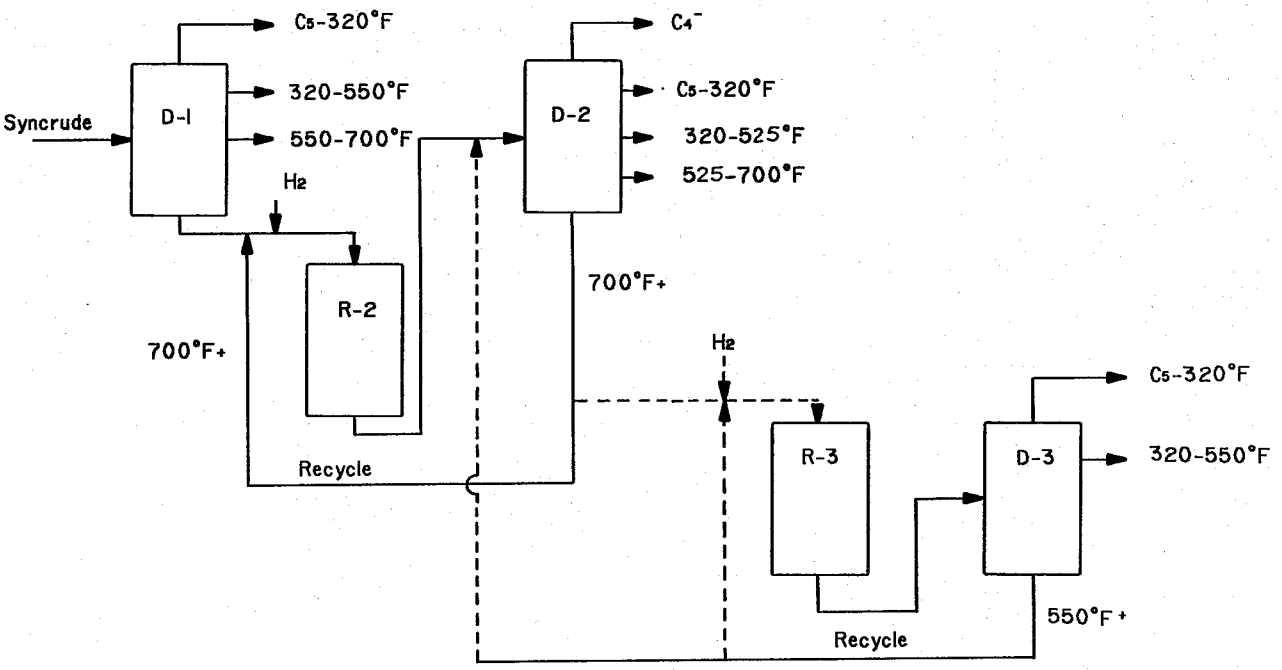
FIG. 2 schematically depicts a process for the production of middle distillate fuels from a syncrude such as produced in a process as described in the preceding FIG. 1; inclusive of an additional process step for obtaining a premium grade jet fuel.

Referring to FIG. 2, syncrude is first introduced into a distillation column D-1 and split into fractions analogous in petroleum refining to naphtha, middle distillate, and heavy gas oil fractions, viz., $C_5$-320° F., 320° F.-550°, 550° F.-700° F., and 700° F.+ fractions, as depicted. The $C_5$-320° F. fraction is recovered as feed for gasoline production. The 320° F.-550° F. fraction is suitable as a diesel fuel, or diesel fuel blending stock, and the 550° F.-700° F. fraction, a product of high cetane number, is suitable as a diesel fuel blending stock.

The highly paraffinic 700° F.+ fraction, though rich in n-paraffins, can be converted into additional diesel fuel, and a premium grade jet fuel. Thus the 700° F.+ fraction is fed, with hydrogen, to a reactor, R-2, and the feed isomerized and hydrocracked at moderate severity over a bed of the fluorided platinum alumina catalyst of this invention to selectively produce lower boiling, lower molecular weight hydrocarbons of greatly improved pour point and freeze point properties. Typically, such reaction is carried out at temperature ranging between about 500° F. and about 750° F. preferably from about 625° F. to about 725° F.. Feed rates of about 0.2 to about 5 V/V/Hr, preferably about 0.5 to about 1 V/V/Hr, are employed. Pressure is maintained at from about 250 psig to about 1500 psig, preferably from about 500 psig to about 1000 psig. Hydrogen is added at a rate of from about 2000 SCF/B to about 15,000 SCF/B, preferably at a rate of from about 4000 SCF/B to about 8000 SCF/B. Effluent from the bottom of the reactor R-2 is fed into a second distillation column D-2, and separated into $C_4$, $C_5$-320° F., 320° F.-550° F., and 550° F.-700° F. hydrocarbon fractions. The very small amount of $C_4$- gas is generally utilized for alkylation of olefins or burned as a fuel to supply process heat, or both, and the $C_5$-320° F. fraction recovered as feed for use in the production of gasoline. If the objective of the process is to maximize the production of diesel fuel, the 320° F.-550° F. and 550° F.-700° F. fuel fractions from distillation column D-2 can be combined with the 320° F.-550° F. and 550° F.-700° F. fuel fractions from distillation column D-1 and, of course, a single distillation column might be used for such purpose. On the other hand, however, the 320° F.-550° F. fraction from D-2 has excellent freeze point qualities and can be used per se as a premium low density jet fuel, or employed as a premium blending stock and blended with jet fuel from other sources. The 700° F.+hydrocarbon fraction is recycled to extinction in R-2.

If it is desirable to optimize the production of a premium jet fuel product, optionally the 700° F.+fraction separated from distillation Column D-2 can be further hydroisomerized and hydrocracked over the fluorided Group VIII metal-on-alumina catalyst of this invention in another reactor R-3, depicted as an alternate process scheme by continued reference to FIG. 2.

Referring to FIG. 2, in an alternate embodiment the 700° F.+bottom fraction from distillation Column D-2 is thus fed, with hydrogen, into reactor R-3. The reaction in R-3 may be carried out at temperature ranging from about 500° F. to about 750° F., preferably from about 600° F. to about 700° F., and at feed rates ranging from about 0.2 V/V/Hr to about 10 V/V/Hr. preferably from about 1 V/V/Hr to about 2 V/V/Hr. Hydrogen is introduced into reactor R-3 at a rate ranging from about 1000 SCF/B to about 8000 SCF/B, preferably from about 4000 SCF/B to about 6000 SCF/B, and pressure is maintained at from about 250 psig to about 1500 psig, preferably from about 500 psig to about 1000 psig.

The product from reactor R-3 is fed into a distillation column D-3 and separated into $C_5$-320° F., 320°-550° F., and 550° F.+ fractions. The 550° F.+ fraction is recycled to distillation column D-2, or recycled to extinction in R-3. The $C_5$-320° F. fraction is recovered from D-3 as feed for gasoline production. The 320°-550° F. fuel fraction is recovered as a premium high density, low freeze point jet fuel fraction, or premium grade jet fuel blending stock.

Motor gasoline can also be produced from the pumpable syncrude when used as a feed supplement for an otherwise conventional catalytic cracking operation. A portion of the high-boiling fraction obtained from the pumpable syncrude via the primary distillation in D-1 as depicted by reference to FIG. 2, e.g., the 700° F.± fraction, can be admixed with a petroleum gas oil or residuum, or synthetic petroleum obtained from shale oil, coal, tar sands or the like, the latter being added in quantity sufficient to supply sufficient carbon to maintain the process in proper heat balance. The high-boiling, or 700° F.+ syncrude fraction, is generally blended with the petroleum in quantity ranging from about 5 percent to about 50 percent, preferably from about 10 percent to about 20 percent, based on the total weight of the admixture of the petroleum gas oil and residuum and the high-boiling, or 700° F.+ syncrude fraction employed as feedstock to a conventional catalytic cracking process.

The particulate catalyst employed in the process of this invention is a fluorided Group VIII metal-on-alumina catalyst composition where Group VIII refers to the Periodic Table of Elements (E. H. Sargent & Co., Copyright 1964 Dyna-Slide Co.). Platinum is the preferred Group VIII metal. It is to be understood that the alumina component of the catalyst may contain minor amounts of other materials, such as, for example, silica, and the alumina herein encompasses alumina-containing materials.

The fluorided Group VIII metal-on-alumina catalyst comprises about 0.1 to about 2 percent, preferably from about 0.3 to about 0.6 percent Group VIII metal and from about 2 percent to about 10 percent fluoride, preferably from about 5 percent to about 8 percent fluoride, based on the total weight of the catalyst composition (dry basis).

The particulate catalyst of the invention will have a fluoride concentration less than about 2.0 weight percent, preferably less than about 1.0 weight percent and most preferably less than 0.5 weight percent at its outer surface. The outer surface is measured to a depth less than one one hundredth of an inch. The surface fluoride was measured by scanning electron microscopy. The remaining fluoride is distributed with the Group VIII metal at a depth below the outer shell into and within the particle interior The platinum contained on the alumina component of the catalyst will preferably have an average crystallite size of up to 50Å, more preferably below about 30Å.

In a preferred embodiment of the invention, the catalyst used to convert the heavy fraction from the syncrude to middle distillates will have high intensity peaks characteristic of aluminum fluoride hydroxide hydrate as well as the peaks normally associated with gamma alumina. X-ray diffraction data (X-ray Diffractometer, Scintag U.S.A.) show that the fluoride present in the preferred catalyst will be substantially in the form of aluminum fluoride hydroxide hydrate. In this connection, the relative X-ray diffraction peak height at $2\theta=5.66$Å is taken as a measure of the aluminum fluoride hydroxide hydrate content of the catalyst. The 5.66Å peak for a Reference Standard (hereinafter defined) is taken as a value of 100. For example, a fluorided platinum-on-alumina catalyst having a hydrate level of 60 would therefore have a 5.66Å peak height equal to 60% of the 5.66Å peak height of the Reference Standard, with a value of 80 corresponding to a catalyst having a 5.66Å peak height equal to 80% of the 5.66Å peak height of the Reference Standard etc. The preferred catalyst used to convert the heavy fraction from the syncrude to middle distillates will have a hydrate level greater than about 60, preferably at least 80, and most preferably at least about 100.

The Reference Standard contains 0.6 wt. % Pt and 5.6 wt. % F on $\gamma$ alumina having a surface area of about 150 $m^2/g$. The Reference Standard is prepared by impregnation of an $\alpha$-alumina with platinum, followed by single contact with an aqueous solution of hydrogen fluoride (11.6 wt. % HF solution) with overnight drying at 300° F.

In its most preferred form, the catalyst of the invention will be relatively free of nitrogen. Such catalyst will have a nitrogen to aluminum (N/Al) ratio less than about 0.005, preferably less than about 0.002, and most preferably less than about 0.0015. This catalyst is described in detail in my co-pending application OP-3236 filed on the same date as the present application.

Except in those instances where it is desired to use the catalyst where the fluoride is predominately in the form of aluminum fluoride hydroxide hydrate, the fluorided Group VIII metal-on-alumina catalyst may be prepared by known techniques. For example, the Group VIII metal, preferably platinum, can be incorporated with the alumina in any suitable manner, such as by coprecipitation or co-gellation with the alumina support, or by ion exchange with the alumina support. In the case of a fluorided platinum-on-alumina catalyst, a preferred method for adding the platinum group metal to the alumina support involves the use of an aqueous solution of a water soluble compound, or salt of platinum to impregnate the alumina support. For example, platinum may be added to the support by co-mingling the uncalcined alumina with an aqueous solution of chloroplatinic acid, ammonium chloroplatinate, platinum chloride, or the like, to distribute the platinum substantially uniformly throughout the particle. Following the impregnation, the impregnated support can then be shaped, e.g., extruded, dried and subjected to a high temperature calcination, generally at a temperature in the range from about 700° F. to about 1200° F., preferably from about 850° F. to about 1000° F., generally by heating for a period of time ranging from about 1 hour to about 20 hours, preferably from about 1 hour to about 5 hours. The platinum component added to the alumina support, is calcined at high temperature to fix the platinum thereupon prior to adsorption of a fluoride, suitably hydrogen fluoride or hydrogen fluoride and ammonium fluoride mixtures, into the platinum-alumina composite. Alternatively the solution of a water soluble compound, or salt of platinum can be used to impregnate a precalcined alumina support, and the platinum-alumina composite again calcined at high temperature after incorporation of the platinum.

The Group VIII metal component is substantially uniformly distributed throughout a precalcined alumina support by impregnation. The Group VIII metal-alumina composite is then calcined at high temperature, and the fluoride, preferably hydrogen fluoride, is distributed onto the precalcined Group VIII metal-alumina composite in a manner that most of the fluoride will be substantially composited at a level below the outer surface of the particles.

The catalysts where the fluoride is substantially in the form of aluminum fluoride hydroxide hydrate are preferably prepared in the following manner. The platinum is distributed, generally substantially uniformly throughout a particulate alumina support and the platinum-alumina composite is calcined. Distribution of the fluoride on the catalyst, preferably hydrogen fluoride, is achieved by a single contact of the precalcined platinum-alumina composite with a solution which contains the fluoride in sufficiently high concentration. Preferably an aqueous solution containing the fluoride in high concentration is employed, a solution generally containing from about 10 percent to about 20 percent, preferably from about 10 percent to about 15 percent hydrogen fluoride. Solutions containing hydrogen fluoride in these concentrations will be adsorbed to incorporate most of the hydrogen fluoride, at an inner layer below the outer surface of the platinum-alumina particles.

The platinum-alumina composite, after adsorption thereupon of the fluoride component is heated during preparation to a temperature ranging up to but not exceeding about 850° F., preferably about 500° F., and more preferably 300° F.. A characteristic of the inner platinum-fluoride containing layer is that it contains a high concentration of aluminum fluoride hydroxide hydrate. It can be shown by X-ray diffraction data that a platinum-alumina catalyst formed in such manner displays high intensity peaks characteristic of both aluminum fluoride hydroxide hydrate and gamma alumina. An X-ray diffraction pattern can distinguish the preferred catalyst of this invention from fluorided platinum alumina catalysts of the prior art.

The invention, and its principle of operation, will be more fully understood by reference to the following examples. All parts are in terms of weight except as otherwise specified.

EXAMPLE 1

This example exemplifies the production of a pumpable syncrude (<70° F. pour point) from a Fischer-Tropsch wax, by reaction of the wax over a fluorided platinum-on-alumina (0.58 wt. % Pt, 7.2 wt. % F) catalyst.

The catalyst was prepared by impregnation of a precalcined commercial reforming catalyst available under the tradename CK-306, in the form of 1/16" diameter extrudates, by contact with hydrogen fluoride (11.6 wt. % HF solution). The catalyst was covered with the HF solution for a period of 6 hours, and occasionally stirred. The HF solution was then decanted from the catalyst, and the catalyst then washed with deionized water. The catalyst was then dried overnight and throughout the day in flowing air, and then dried in an oven overnight at 260° F. The catalyst after drying was reduced by contact with hydrogen at 650° F. The catalyst has pores of average diameter ranging from about 100Å to 150Å, a pore volume of from about 0.5 cc/g to 0.6 cc/g, and a surface area of 121.8 $m^2/g$.

The catalyst was employed to hydrocrack and hydroisomerize a 550° F.+ fraction split from a raw Fischer-Tropsch wax obtained by reaction of a synthesis gas over a ruthenium catalyst. The raw Fischer-Tropsch wax was thus split into 550° F.− and 550° F.+ fractions, and the 550° F.+ fraction was reacted over the catalyst. The $C_5$+ liquid products obtained from the run was then blended back, in production amounts, with the raw Fischer-Tropsch 550° F.−fraction to obtain a pumpable syncrude product. The process conditions for the run, the characterization of the raw Fischer-Tropsch feed obtained by reaction over the ruthenium catalyst, and the pumpable syncrude product obtained by the run is given as follows:

| Process Conditions | | |
|---|---|---|
| Temperature, °F. | 660 | |
| Pressure, psi | 1000 | |
| Space Velocity, V/V/Hr. | 0.5 | |
| Gas Rate, Scf $H_2$/Bbl | 8000 | |
| Syncrude Product | | Raw Fischer Tropsch Wax Feed |
| Gravity API | 44.8 | 39.0 |
| Pour Point, °F. | 21 | Hard Solid |
| Viscosity, CS @ 100° F. | 13.2 | |
| Product Distribution, wt. % | | |
| IBP - 160° F. | 1.0 | nil |
| 160–320° F. | 2.2 | 1.9 |
| 320–550° F. | 18.7 | 12.0 |
| 550–650° F. | 29.8 | 22.1 |
| 650° F.+ | 66.9 | 76.0 |
| Diesel product from a syncrude recoverable from D-1 of FIG. 2 had the following properties. | | |
| Gravity API @ 60° F. | 49.8 | |
| Pour Pt. °F. | 55 | |
| Cetane Number | 80 | |

EXAMPLE 2

This example illustrates the preparation of middle distillate products from the 700° F.+ fraction of the raw Fischer-Tropsch syncrude as is described by reference to FIG. 2. The 700° F.+ fraction was reacted, with hydrogen, over each of Catalysts A, B, and C, respectively, at 50 percent conversion to obtain a product; the product from Catalyst A being hereinafter referred to as Product A, the product from Catalyst B is Product B, and the product from Catalyst C as Product C.

Catalyst A is the catalyst of Example 1. Catalyst B was prepared in the manner of Catalyst A except that Catalyst B after drying was calcined at 1000° F. and thereafter reduced with hydrogen at 650° F. X-ray diffraction profiles made of each of these catalysts show that a major concentration of the fluoride on Catalyst A is present as aluminum fluoride hydroxide hydrate whereas Catalyst B does not contain any significant concentration of aluminum fluoride hydroxide hydrate. Catalyst C (non-sulfided form) is a commercially obtained nickel-silica/alumina (5 wt.% NiO) catalyst of a type commonly used in hydrocracking operations with low nitrogen-containing hydrocarbons and sold under the tradename Nickel 3A. Catalyst D is a commercially obtained palladium (0.5%) on hydrogen faujasite that is commonly used for hydrocracking heavy hydrocarbons to naphtha and distillate.

Process conditions for each of the runs with Catalysts A, B, C, and D and the distribution of the products obtained are tabulated below.

| | Catalyst | | | |
|---|---|---|---|---|
| | A | B | C | D |
| Process Conditions | | | | |
| Temperature, °F. | 660 | 700 | 576 | 534 |
| Pressure, psi | 1000 | 1000 | 1000 | 1000 |
| V/V/Hr. | 0.45 | 0.45 | 0.45 | 0.5 |
| Gas Rate, Scf $H_2$/Bbl | 8000 | 8000 | 5000 | ~4500 |
| Product Distribution Yield on Feed, Wt. % | | | | |
| $H_2O$ | 0.27 | 0.27 | 0.27 | 0.27 |
| $C_3$ | 1.9 | 0.9 | 1.7 | 16.0 |
| $C_4$ | 1.7 | 1.7 | 8.8 | 37.6 |
| $C_5$-320° F. | 11.7 | 9.4 | 35.0 | 48.6 |
| 320–700° F. | 67.2 | 61.7 | 28.5 | 0.3 |
| 700° F.+ | 18.1 | 26.8 | 27.2 | nil |

These data show that Catalyst A is more effective for the conversion of the feed to gasoline and middle distillates, without excessive gas formations than Catalyst B even at lower temperatures. Catalyst C, on the other hand, shows poor selectivity for distillate production and excessive gas formation relative to Catalyst A. Catalyst D even when operating at a lower temperature gave excessive cracking to gas and naphtha. Operation at a lower level of conversion produced mostly naphtha and low selectivity for distillates.

A diesel product (320°–700° F.) recoverable as product A from D-2 of FIG. 2 had the following properties.

| | |
|---|---|
| Gravity, API @ 60° F. | 49.4 |
| Pour Pt., °F. | 0 |
| Cetane Number | 65 |

A jet fuel product (320-550° F.) recoverable as product A from D-3 of FIG. 2 had the following properties.

| | |
|---|---|
| Gravity, API @ 60° F. | 53.6 |
| Freeze Pt., °F. | −65 |
| Luminometer No | 75 |
| Hydrogen, wt. % | 15.2 |

A blend of diesel product (320-700° F.) recoverable as product A from FIG. 2 by blending all products from R-2 and R-3 of FIG. 2 when recycling to extinction the 700° F.+ product from D-2 had the following properties.

| | |
|---|---|
| Gravity, API @ 60° F. | 50.5 |
| Pour Pt., °F. | 30 |
| Cetane Number | 55 |

Having described the invention, what is claimed is:

1. A process for producing a pumpable syncrude from a Fischer-Tropsch wax containing oxygenate compounds, which comprises:

(1) separating the Fischer-Tropsch wax into (a) a low-boiling fraction which contains most of the oxygenate compounds and (b) a high-boiling fraction which is substantially free of water and oxygenate compounds, (2) reacting the high-boiling fraction from step (1) with hydrogen at hydroisomerization and mild hydrocracking conditions in the presence of a fluorided Group VIII metal-on-alumina catalyst to produce a $C_5+$ hydrocarbon product, and (3) combining the $C_5+$ hydrocarbon product from step (2) with the low-boiling fraction from step (1) to produce a pumpable, refinery processable syncrude that can be transported at atmospheric conditions.

2. The process of claim 1 wherein said Group VIII metal is platinum.

3. The process of claim 2 wherein said high boiling fraction has an initial boiling point between about 450° F. and about 650° F.

4. The process of claim 3 wherein said catalyst is fluorided platinum-on-alumina catalyst containing about 0.1 to about 2 percent platinum and about 2 to about 10 percent fluoride.

5. The process of claim 4 wherein said high boiling fraction has an initial boiling point between about 500° F. and about 600° F.

6. The process of claim 5 wherein said catalyst has a fluoride concentration less than about 2.0 weight percent at the outer surface to a depth less than one one hundredth of an inch and said catalyst contains from about 0.3 to about 0.6 percent platinum and about 5 to about 8 percent fluoride based on the total weight of the catalyst composition.

7. The process of claim 1 wherein (a) said syncrude is fractionated to produce at least a middle distillate fraction and a residual fraction which has an initial boiling point ranging between about 650° F. and about 750° F. and (b) said residual fraction is reacted with hydrogen in a second hydroisomerization/hydrocracking zone in the presence of a Group VIII metal-on-alumina catalyst to produce a middle distillate fuel product, lighter products including a gasoline fraction, and a residual product.

8. The process of claim 7 wherein said Group VIII metal is platinum.

9. The process of claim 8 wherein said residual fraction has an initial boiling point ranging between about 625° F. and about 725° F.

10. The process of claim 7 wherein at least a portion of the residual fraction separated from the syncrude is catalytically cracked to produce gasoline.

* * * * *